United States Patent [19]

Jenkins

[11] 4,077,497

[45] Mar. 7, 1978

[54] YARN CLAMP

[75] Inventor: Ellis H. Jenkins, Lanett, Ala.

[73] Assignee: West Point Pepperell, Inc., West Point, Ga.

[21] Appl. No.: 682,045

[22] Filed: Apr. 30, 1976

[51] Int. Cl.[2] ..... B65H 59/16; D03D 45/50

[52] U.S. Cl. ..... 188/65.1; 139/247; 139/450; 112/59; 188/166; 24/263 SB; 139/194

[58] Field of Search ..... 139/247, 256, 257, 224 A, 139/194, 450; 242/149, 150; 188/65.1, 166, 65.2; 66/146; 24/115 R, 115 G, 263 SB; 112/253-255, 59

[56] References Cited

U.S. PATENT DOCUMENTS

| | | | |
|---|---|---|---|
| 21,398 | 8/1858 | Rogers | 242/149 |
| 707,094 | 8/1902 | Fowler | 112/59 UX |
| 982,234 | 1/1911 | Blair | 112/59 |
| 1,029,283 | 6/1912 | Fowler | 112/59 UX |
| 1,125,679 | 1/1915 | Fessmann | 242/149 |
| 1,444,754 | 2/1923 | Pruden | 24/115 G |
| 2,624,370 | 1/1953 | Flamand | 139/450 |
| 3,411,550 | 11/1968 | Jenkins, Jr. | 139/247 |

FOREIGN PATENT DOCUMENTS

| | | | |
|---|---|---|---|
| 2,109,440 | 9/1972 | Germany | 139/450 |

*Primary Examiner*—James Kee Chi

*Attorney, Agent, or Firm*—Cushman, Darby & Cushman

[57] ABSTRACT

A cylindrical body houses a shaft and is movable with respect thereto. The body carries a first jaw element at one end thereof. A second jaw element is joined to fixed support means connected to the shaft within the body. A compression spring surrounds a portion of the shaft projecting from the opposite end of the body, and the spring urges the jaw elements into clamping relationship. The clamp is opened by moving the body in opposition to the force of the spring.

8 Claims, 4 Drawing Figures

YARN CLAMP

BACKGROUND OF THE INVENTION

The present invention is directed to a yarn clamp which is particularly suitable for use with a piece of textile equipment known as a Unifil Winder produced by the Leesona Corporation of Warwick, Rhode Island.

During the process of manufacturing fabric using a Unifil Winder, yarn is dispensed from a bobbin by means of a shuttle in order to provide the fill for the fabric. As the yarn supply on the bobbin becomes depleted, it is necessary to replace the bobbin with a new one. The need for such replacement is detected by a fill feeler associated with the loom. The feeler actuates a transfer mechanism to effect the bobbin transfer.

Prior to the bobbin transfer operation, the yarn tail of the replacement bobbin is held by the holding and tensioning drum. Thus, proper tension exists on the yarn between the holding drum and the replacement bobbin that is properly positioned for transfer in the Unifil Winder.

At the time of transfer, it is essential that the yarn tail of the replacement bobbin be securely held. If proper clamping does not occur, this tail will be pulled away from the holding drum, causing either defective fabric to be produced or the loom to stop due to detecting of the absence of a fill thread. However, with the tail firmly clamped, the integrity of the fill is maintained throughout the transfer operation.

Conventionally, clamps used with a Unifil Winder are of the general type disclosed in U.S. Pat. No. 3,411,550 to Jenkins and U.S. Pat. No. 3,452,784 to Sides. Such clamps are formed by complex mechanical linkages which are expensive, and they suffer additional shortcomings such as short life, difficulty in maintaining proper adjustment, lack of control of clamping tension, and the like.

Another prior art yarn clamp is disclosed in U.S. Pat. No. 3,797,532 to Haltmeier. While this clamp is structurally more similar to the present invention than are the clamps represented by U.S. Pat. Nos. 3,411,550 and 3,452,784, it also has disadvantages of the type just described.

The yarn clamp according to the present invention structurally is considerably simpler and less expensive than conventional clamps. Additionally, it is not as subject to wear, has adjustable clamp tension, will hold yarn securely and requires less adjustment than conventional clamps.

SUMMARY OF THE INVENTION

Briefly, the invention comprises a cylindrical body to one end of which a jaw element is secured. A shaft coaxial with the cylinder is housed therein. The shaft projects from the opposite end of the cylinder. The shaft has threads at its projecting end for receiving retaining nuts which secure a compression spring between the cylinder and the nuts. A fixed support means is attached to the portion of the shaft within the cylindrical body and extends therefrom to hold a second jaw element. The compression spring urges the cylindrical body in a direction to bring the jaws into firm engagement. To open the clamp, the body is moved along the shaft against the force of the spring.

The invention will be described in further detail with reference to the accompanying drawings wherein.

DETAILS OF THE INVENTION

Figure 1:
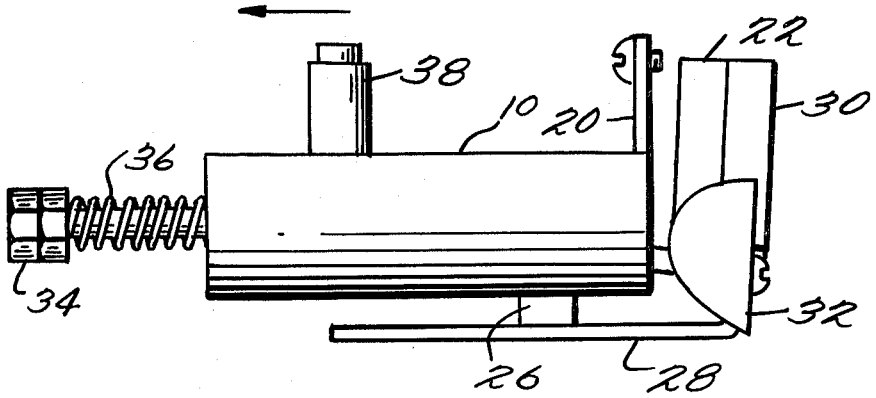
FIG. 1 is a side elevational view of the yarn clamp illustrated in its closed position.
Figure 2:
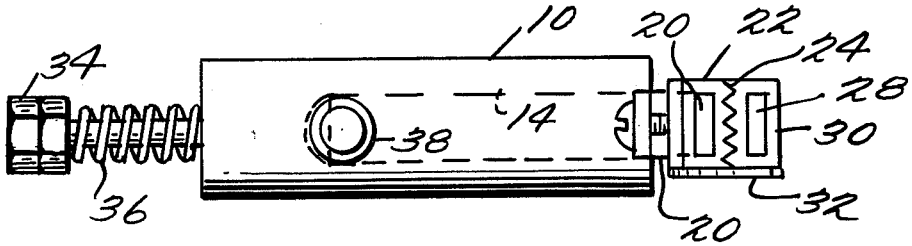
FIG. 2 is a top plan view thereof.

Referring to the drawings, a cylindrical clamp body 10 is machined to form circular opening 12 at one end thereof and a slotted opening 14 extending axially of the cylinder from its other end to intersect opening 12. A cylindrical sleeve 16, preferably made from a synthetic such as nylon, is positioned within openings 12 and 14 to guide a shaft 18 arranged to be coaxial with body 10.

A U-shaped member 20 is secured by one of its arms to one end of body 10, the lower part of member 20 projecting into slotted opening 14. The free end of member 20 carries a jaw element 22 comprising a rubber piece serrated in the vertical direction, as indicated by numeral 24.

The end of shaft 18 adjacent member 20 is secured to a bar 26, the bar extending transversely of the shaft axis to project beyond the slotted opening 14 in body 10. An L-shaped member 28 is joined to bar 26. A free end of member 28 supports a second jaw element 30 which is also a serrated rubber piece similar to element 22. Member 28 also supports a shield or guide plate 32 the function of which will be described hereinafter. The portion of member 28 remote from element 30 is fixedly secured to a Unifil Winder (not shown).

Figure 4:
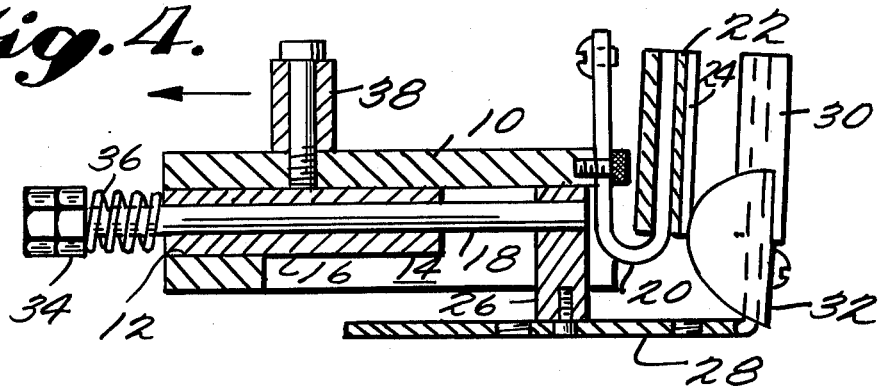
FIG. 4 is a side elevational view, partially in section, of the yarn clamp in its open position.

A post 38 is secured in conventional manner to the exterior of body 10. During normal operation of a loom with a bobbin supplying yarn thereto, a transfer mechanism (not shown) associated with the loom engages post 38 to urge body 10 against the force of spring 36 in the direction shown by the arrow in FIG. 4 to a position wherein the jaw elements 22 and 30 are separated to permit yarn to pass therebetween. The amount of separation is established by appropriate adjustment of the transfer mechanism. The shield 32 retains the yarn in proper position between the jaw elements.

Figure 3:
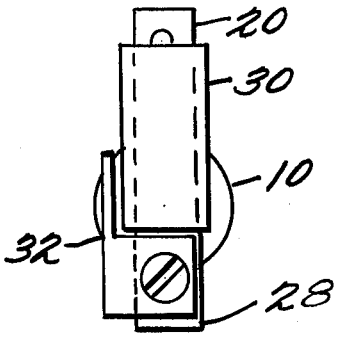
FIG. 3 is an end elevational view thereof.

The transfer mechanism maintains the yarn clamp in the open position just described until a transfer of bobbins is required by the loom. When this occurs, the transfer mechanism releases post 38, and spring 36 moves body 10 in the direction opposite to that shown by the arrow in FIG. 3 until jaw elements 22 and 30 meet. Even when the jaw elements are so positioned, the spring 36 continues to exert force on body 10, and as a result, any yarn tail between elements 22 and 30 is firmly clamped. The yarn tail is so held until the transfer of bobbins is completed at which time the post 38 again is engaged by the transfer mechanism to open the clamp, as previously described.

From the foregoing description, it is apparent that the present invention comprises a small number of moving parts, and the arrangement is such that wear problems are minimized. The orientation of the axes of body 10, shaft 18 and support member 28 in a common plane prevents misalignment of the yarn clamp. The use of adjustable nuts 34 permits the compression of spring 36 to be varied. Thus, the gripping force between jaw elements 22 and 30 can be controlled easily to provide a firm grip of yarn tails located within the jaw. In this regard, the strength of the spring urging the clamp to the closed position also can be selected to accommodate the type of yarn being handled.

What is claimed is:

1. A yarn clamp comprising:

a movable clamp body;

a jaw element connected in fixed relationship to one end of said body;

a shaft housed within said body and extending coaxially therewith, said shaft projecting from and extending beyond the opposite end of the body;

a compression spring surrounding the portion of the shaft extending beyond said body;

fixed support means secured to the portion of the shaft within said body and projecting through a slotted opening along said body intermediate its ends;

an additional jaw element connected to said support means and positioned to be contacted by said first-mentioned jaw element in accordance with displacement of the body by the spring relative to said shaft; and means joined to the exterior of the body for receiving a force in opposition to that of the spring and for displacing the body relative to said shaft to separate said jaw elements.

2. A yarn clamp as set forth in claim 1, wherein said body is cylindrical.

3. A yarn clamp as set forth in claim 1, further comprising a U-shaped member secured by one arm to said one end of the body and having the first-mentioned jaw element secured to the other arm of said member.

4. A yarn clamp as set forth in claim 1, wherein the extending portion of the shaft is threaded and said adjusting means comprises a nut received on the threads, said spring being positioned between the nut and said body.

5. A yarn clamp as set forth in claim 1 wherein the axes of the body, shaft and support means lie in a common plane.

6. A yarn clamp as set forth in claim 1, further comprising a cylindrical sleeve positioned within the openings in said body, said shaft being located along the axis of said sleeve.

7. A yarn clamp comprising:

a cylindrical movable clamp body;

a U-shaped member secured by one arm to one end of said body and having a jaw element secured to the other arm of said member;

a shaft housed within said body and extending substantially coaxially therewith, said shaft projecting from and extending beyond the opposite end of the body;

a compression spring surrounding the portion of the shaft extending beyond said body;

a nut received on threads on the extending portion of the shaft, said spring being positioned between the nut and said body and being controlled in compressive force in accordance with the position of the nut on the shaft;

fixed support means secured to the portion of the shaft within said body and projecting through a slotted opening along said body intermediate its ends, said support means having an axis arranged in a common plane with the axes of said body and the shaft;

an additional jaw element connected to said support means and positioned to be contacted by said first-mentioned jaw element in accordance with displacement of the body by the spring relative to said shaft; and means joined to the exterior of the body for securing a force in opposition to that of the spring and for displacing the body relative to said shaft to separate said jaw elements.

8. A yarn clamp as set forth in claim 7, further comprising a cylindrical sleeve positioned within the openings in said body, said shaft being located along the axis of said sleeve.

* * * * *